United States Patent [19]

Sondej

[11] Patent Number: 4,991,846

[45] Date of Patent: Feb. 12, 1991

[54] VARIABLE POSITION TARGET ASSEMBLY

[75] Inventor: Donald M. Sondej, Cicero, Ill.

[73] Assignee: Williams Electronics Games, Inc., Chicago, Ill.

[21] Appl. No.: 424,992

[22] Filed: Oct. 23, 1989

[51] Int. Cl.[5] ..... A63B 69/00

[52] U.S. Cl. ..... 273/127 R

[58] Field of Search ..... 273/127 R, 127 A, 118 A, 273/119 A, 120 A, 121 A, 122 A, 123 A, 124 A, 125 A, 126 A, 127 B, 127 C, 181 R, 85 F, 316, 348, 355, 368, 371, 374, 386; 200/61.11

[56] References Cited

U.S. PATENT DOCUMENTS 4,199,141 4/1980 Garcia ..... 273/26 A 4,856,785 8/1989 Lantz et al. ..... 273/148 B

FOREIGN PATENT DOCUMENTS 1373806 8/1964 France ..... 213/121 A 8702642 2/1987 France ..... 273/29 R

*Primary Examiner*—Theatrice Brown

*Attorney, Agent, or Firm*—Rockey and Rifkin

[57] ABSTRACT

A variable position target assembly for pinball machines comprises a target and shaft assembly mechanically linked to an opto-interrupter or other transducer. As the shaft assembly is linearly displaced incrementally, its movement causes the transducer to signal at each increment a main processing unit of the pinball game to assign a score or other award.

10 Claims, 1 Drawing Sheet

FIG. 1
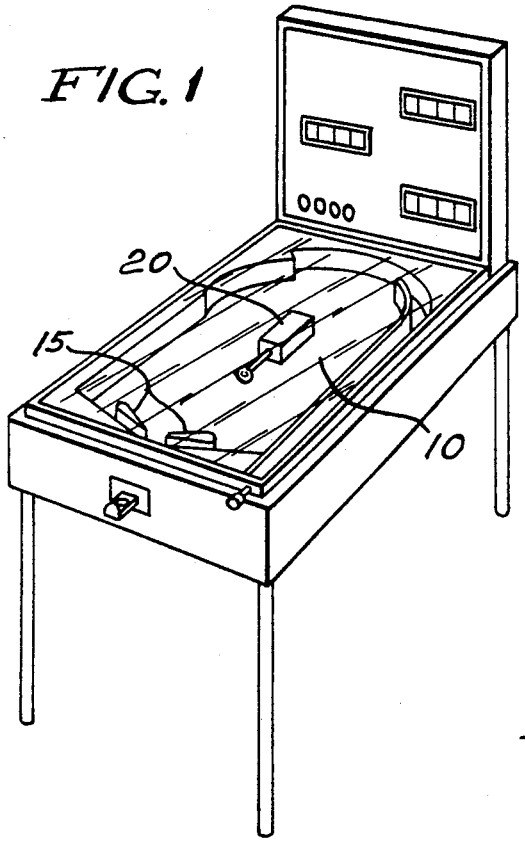
FIG. 3
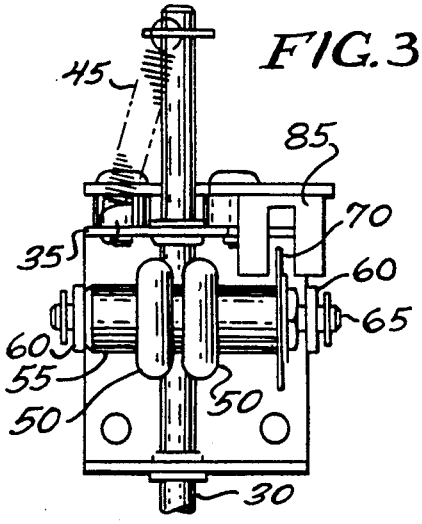
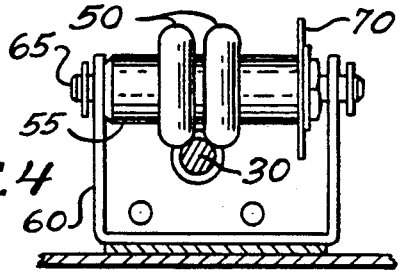
FIG. 4
FIG. 2
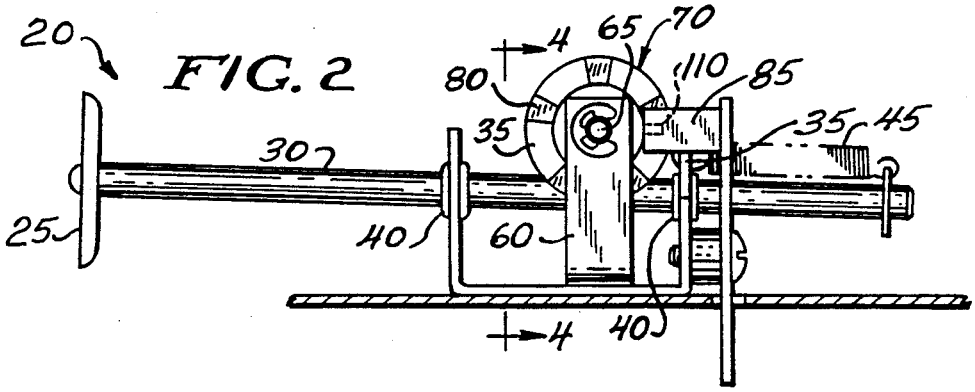
FIG. 5
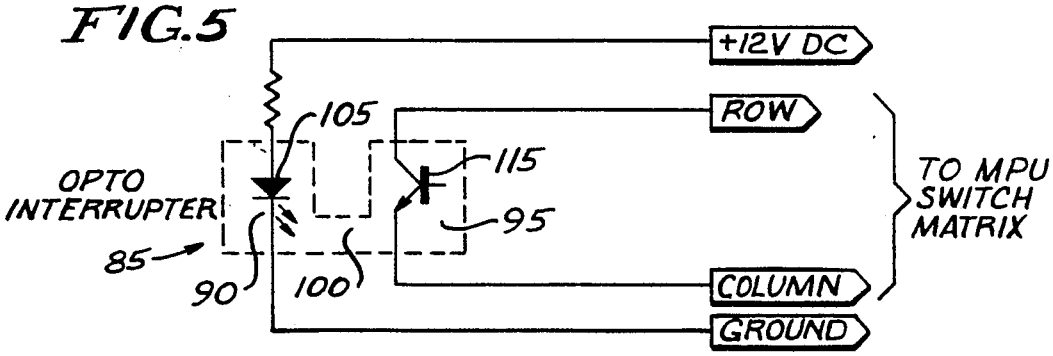

VARIABLE POSITION TARGET ASSEMBLY

BACKGROUND OF THE INVENTION

The present invention relates generally to pinball games, and more particularly to a target assembly for pinball games.

Pinball games, as commonly known, consist of an inclined playfield and a plurality of play features arranged on the playfield. A player uses flippers or similar means to direct a ball at playfield features such as targets or ramps in order to score points. A fixed number of points are typically assigned to each playfield feature, though the number of points may be changed through multipliers awarded as a result of other playfield activity.

Players select pinball machines based on several criteria, including the variety and originality of playfield features found on the machines. Another factor considered by players is the degree of skill necessary to maximize scored points or to strike particular targets. Thus, the success of a particular pinball game, or series of games, is dependent upon the inclusion of new and original playfield features in such games that challenge the players and stimulate interest in the machines.

Accordingly, it is an object of the present invention to provide a novel playfield feature in the form of a target having variable positions for achieving different point values, resulting in a game that is more challenging to players.

It is a further object of the invention to provide such a playfield feature include an optical device for transducing the target position into an electronic signal for communication with a processor, for awarding points based on target position.

These and other objects of the invention will become apparent to those skilled in the art.

SUMMARY OF THE INVENTION

The present invention is a variable position target assembly for pinball machines comprising a target and shaft assembly mechanically linked to an opto-interrupter or similar transducer. As the shaft assembly is linearly displaced, its movement causes rotation of the opto-interrupter, resulting in the transmission of a signal to the main processing unit of the pinball game. Points may be assigned by the processor based upon target position as signalled to the processor by the opto-interrupter.

BRIEF DESCRIPTION OF THE DRAWINGS

FIG. 1 is a simplified plan view of a pinball machine incorporating a variable position target assembly.

FIG. 2 is a side view of one embodiment of the variable position target assembly.

FIG. 3 is a top view of one embodiment of the invention.

FIG. 4 is a sectional view taken along line 4—4 of FIG. 2.

FIG. 5 is a schematic diagram of the opto-interrupter circuit.

DETAILED DESCRIPTION OF A PREFERRED EMBODIMENT

FIG. 1 shows a pinball machine of the type in which the present invention may be employed. Such a pinball machine includes, a playfield 10 upon which the variable position target assembly of the present invention may be found. Playfield 10 typically is inclined downward toward to the front of the machine, where flippers 15 are located.

In the operation of the pinball machine, a pinball (not shown) moves downward along playfield 10 toward flippers 15, which are actuated by the operator to strike the ball and send it toward one or more targets or playfield features located on playfield 10. Such targets may include a variable position target assembly 20, as shown in detail in FIG. 2.

The variable position target assembly 20 comprises a target 25 fixedly mounted to a shaft 30. Shaft 30 is movably supported by support 35, which includes a linear bearing sleeve 40 permitting gliding, linear movement of shaft 30 through support. Shaft 30 is connected to a spring 45 at its end opposite the target 25. The spring 45 is linked to support 35, whereby shaft 30 is biased to oppose linear movement of the type described. Thus, a pinball striking target 25 will cause shaft 30 to move from left to right in FIG. 2, said movement being opposed by the force of spring 45. Spring 45 will also cause shaft 30 to return to its original position after linear displacement.

Shaft 30 is in rolling contact with shaft guides 50, which are mounted upon an elongated cylindrical roller 55, as shown in FIGS. 3 and 4. During linear movement of shaft 30, the shaft guides 50 insure smooth displacement of the shaft. Shaft guides 50 also maintain proper tracking of shaft 30 in the event that target 25 is hit from the side or at an angle. Roller 55 is mounted to a support 60 by a pin 65. Another view of the connection between shaft 30 and shaft guides 50 is shown in FIG. 4.

An optical disk 70 is concentrically mounted to roller 55. Optical disk 70 includes a plurality of opaque segments 75 alternating with a plurality of transparent segments 80, as shown in FIG. 2. Optical disk 70 is of sufficient diameter to provide for the passage of its periphery through opto-interrupter 85, as shown in FIGS. 2 and 3.

In the embodiment shown, opto-interrupter 85 is a U-shaped device consisting of a transmitting segment 90 and a receiving segment 95, joined by a bridge 100. This is illustrated graphically in FIG. 5, which shows the electrical components of the opto-interrupter, a device well known in this art. The transmitting section 90 comprises light producing means 105, such as a light-emitting diode, connected to a power supply and ground and a window 110 through which light from diode 105 may be transmitted to receiving segment 95. Window 110 is shown by phantom lines in FIG. 2. Receiving segment 95 comprises photosensitive receptor means 115, such as a photovoltaic cell, which relays an electrical signal to the main processing unit of the game.

Because of the interaction between optical disk 70 and opto-interrupter 85, these two elements will herein be described as an optical transducer.

In the operation of the present invention, a pinball striking target 25 cause the linear displacement of shaft 30, and concomitantly the rotation of roller 55 and optical disk 70. Light passing from transmitting segment 90 of opto-interrupter 85 to the receiving segment 95 is interrupted by opaque portions 75 of optical disk 70, but passes through its transparent portions 80. Thus, receiving segment 95 receives light only in the discrete intervals during which light passes through transparent portions 80 of optical disk 70. Information concerning the number of such intervals is passed in the form of signal pulses from the photosensitive receptor 115 to the main processing unit of the game, and may be used to trigger other playfield activity or award points.

Scoring may be linked to the number of pulses generated, with a maximum score being associated with the detection of a preset number of pulses. For example, it may be desirable to provide for a maximum score where shaft 30 has been displaced to an intermediate position, thereby challenging the player to exercise skill to achieve a maximum number of points.

Other known means for transducing linear shaft position into a signal for processing by the main processing unit, besides the optical transducer described above, may be incorporated into the variable position target assembly 20 of the present invention.

The present invention has been described with respect to certain embodiments and conditions, which are not meant to and should not be construed to limit the invention. Those skilled in the art will understand that variations from the embodiments and conditions described herein may be made without departing from the invention as claimed in the appended claims.

What is claimed is:

1. A variable position target assembly for pinball games, comprising:

a target connected to one end of a linearly displaceable shaft, said shaft being supported on a playfield for linear displacement in response to being struck by a pinball; and, transducing means for converting the linear position of said shaft to an electrical signal, said electrical signal indicating discretely the position of said shaft at a plurality of points along the longitudinal axis of said shaft.

2. The target assembly of claim 1, wherein said transducing means comprises an optical transducer.

3. The target assembly of claim 2, wherein the optical transducer comprises an optical disk and an opto-interrupter.

4. The target assembly of claim 3, wherein said opto-interrupter includes a light emitting diode.

5. The target assembly of claim 3, wherein said opto-interrupter includes a photo-sensitive receptor.

6. The target assembly of claim 1, wherein said target further comprises a processing unit for converting said electrical signal into a score output.

7. The target assembly of claim 6, wherein the score output of said processing unit is maximized when the linear displacement of said shaft is less than the maximum possible linear displacement.

8. The target assembly of claim 1, wherein the transducing means is connected to the shaft by a mechanical linkage.

9. The target assembly of claim 1, further comprising means to bias the shaft to a first position, said pinball linearly displacing said shaft from said first position by a variable amount.

10. The target assembly of claim 1, further comprising means for maintaining proper tracking of the shaft during linear displacement.

* * * * *